US007140116B2

(12) United States Patent
Coffin

(10) Patent No.: US 7,140,116 B2
(45) Date of Patent: Nov. 28, 2006

(54) RAZOR HAVING A MULTI-POSITION SHAVING HEAD

(75) Inventor: David C. Coffin, Hamden, CT (US)

(73) Assignee: Eveready Battery Company, Inc., St. Louis, MO (US)

( * ) Notice: Subject to any disclaimer, the term of this patent is extended or adjusted under 35 U.S.C. 154(b) by 67 days.

(21) Appl. No.: 10/876,202

(22) Filed: Jun. 24, 2004

(65) Prior Publication Data

US 2005/0000100 A1 Jan. 6, 2005

Related U.S. Application Data

(60) Provisional application No. 60/482,534, filed on Jun. 25, 2003.

(51) Int. Cl.
*B26B 21/52* (2006.01)
*B26B 21/28* (2006.01)
*B26B 21/22* (2006.01)

(52) U.S. Cl. ..... 30/531; 30/527; 30/529

(58) Field of Classification Search ..... 30/47, 30/50, 527, 529, 531, 532, 533
See application file for complete search history.

(56) References Cited

U.S. PATENT DOCUMENTS

| | | | | |
|---|---|---|---|---|
| 831,259 A | | 9/1906 | Bingler | |
| 1,247,266 A | | 11/1917 | Hartman | |
| 1,247,581 A | | 11/1917 | Seitz | |
| 2,609,251 A | | 9/1952 | Haupt | |
| 2,748,470 A | * | 6/1956 | Borden | 30/531 |
| 3,964,160 A | | 6/1976 | Gordon | |
| 4,083,103 A | | 4/1978 | Estandian | |
| 4,152,828 A | * | 5/1979 | Lund | 30/529 |
| 4,163,316 A | * | 8/1979 | Hagmann et al. | 30/47 |
| 4,347,663 A | * | 9/1982 | Ullmo | 30/47 |
| 4,617,736 A | * | 10/1986 | McCrary | 30/169 |
| 5,070,614 A | | 12/1991 | Hardin et al. | |
| 5,093,991 A | | 3/1992 | Hendrickson | |
| 5,167,069 A | * | 12/1992 | Quinn | 30/527 |
| 5,206,995 A | * | 5/1993 | Min | 30/527 |
| 5,526,568 A | | 6/1996 | Copelan | |
| 5,787,594 A | | 8/1998 | Estrada | |

FOREIGN PATENT DOCUMENTS

| | | |
|---|---|---|
| JP | 2-280789 | 11/1990 |
| JP | 2003 190676 A | 7/2003 |

* cited by examiner

*Primary Examiner*—Hwei-Siu Payer
(74) *Attorney, Agent, or Firm*—Michaud-Duffy Group LLP

(57) ABSTRACT

In a shaving implement a handle is provided that includes a body section and an end portion projecting outwardly therefrom. An axle member is rotatably coupled to the end portion for selective angular movement relative thereto. A razor cartridge is coupled to the axle member and includes at least one razor blade that defines an at least partially exposed cutting edge. The razor cartridge is rotatably moveable with the axle member and the detent is provided for releasably retaining the axle member and thereby the razor cartridge in the user selected angular position relative to the handle.

11 Claims, 5 Drawing Sheets

RAZOR HAVING A MULTI-POSITION SHAVING HEAD

CROSS-REFERENCE TO RELATED APPLICATIONS

This application is entitled to the benefit of and incorporates by reference essential subject matter disclosed in Provisional Patent Application No. 60/482,534 filed on Jun. 25, 2003.

FIELD OF THE INVENTION

The present invention generally relates to shaving implements and more particularly to a razor wherein a razor cartridge is movable in a ratchet-like manner relative to a handle to which the cartridge is coupled.

BACKGROUND OF THE INVENTION

Modern wet shave razors typically employ a blade carrying razor cartridge that pivots or rotates about an axis that is positioned approximately perpendicular to a handle forming part of the razor. While a wet shave razor configured in this manner can follow the contours of a user's skin better than a razor employing a fixed cartridge, the razor can be difficult to properly position when shaving areas such as an armpit. To achieve a close shave in such an area, one must orient one's hand in uncomfortable positions so that the razor cartridge, and thereby the exposed razor blades carried therein, can be drawn over all of the skin to be shaved. Accordingly, there is a need for a wet shave razor that allows a user to appropriately orient the razor cartridge relative to the area being shaved without having to uncomfortably contort one's arm or hand.

Another difficulty associated with the above-described wet shave razors is that the razor cartridge is only able to cut hair when stroked in one particular direction. This results in a user having to reposition the razor between successive strokes. This adds to the amount of time one spends shaving as well as increases the potential for shaving discomfort.

Based on the foregoing, it is the general object of the present invention to provide a shaving implement that improves upon or overcomes the problems and drawbacks associated with prior art wet shave razors.

SUMMARY OF THE INVENTION

The present invention resides in a shaving implement that includes a handle having a body section and an end portion projecting outwardly from the body section. An axle member is rotatably coupled to the end portion for selective angular movement relative thereto. A razor cartridge is also provided and includes at least one razor blade defining an at least partially exposed cutting edge. The razor cartridge is coupled to the axle member such that it is rotatable therewith. Detent means releasably retain the axle member in a user selected angular position relative to the handle. Accordingly, during a shaving operation, should a user wish to selectively rotate the razor cartridge to a different position relative to the handle, the detent means will ensure that the cartridge is releasably retained in the desired position.

In an embodiment of the present invention, the axle member includes a mounting portion rotatably receivable in a bore defined by the end portion of the razor handle. The detent means is defined in part by at least two recesses circumferentially located on the mounting portion. The detent means further includes a detent member moveably engageable with the recesses. Biasing means are provided for normally urging the detent member toward the mounting portion of the axle member. Accordingly, rotation of the cartridge results in ratchet-like movement between the axle member and the handle such that a force exerted by the biasing means on the detent member must be overcome, thereby forcing the detent member away from the recess until the next successive recess is encountered.

In another embodiment of the present invention, the razor cartridge includes at least one first razor blade defining an at least partially exposed first cutting edge, and at least one second razor blade defining an at least partially exposed second cutting edge. The first and second razor blades are positioned relative to one another such that during a shaving operation, the razor cartridge cuts hair when drawn over a user's skin in either of two generally opposite directions.

An advantage of the present invention is that the razor cartridge can be rotated to a desired position and the detent means will releasably retain the cartridge in that position. This allows a user to shave in normally awkward to reach places without having to uncomfortably contort his/her hand or arm.

Another advantage of the present invention is that in one embodiment the user can orient the razor cartridge to a desired position, as well as cut hair from a surface by stroking the razor in either of two generally opposed directions.

DETAILED DESCRIPTION OF THE PREFERRED EMBODIMENT

Figure 1:
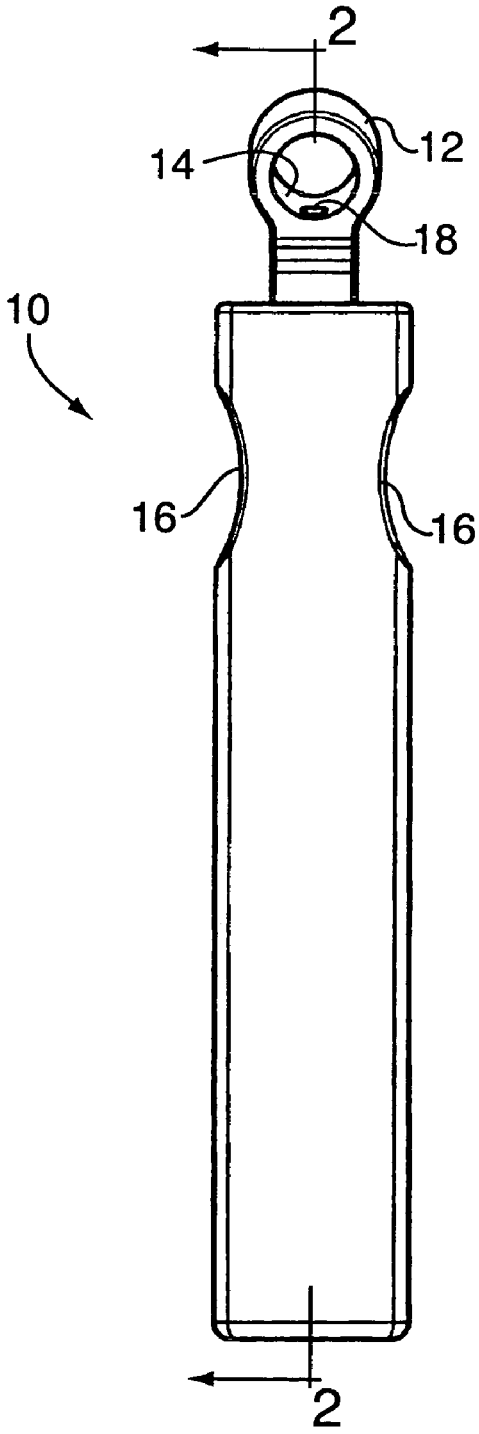
FIG. 1 is a front elevational view of a handle forming part of an embodiment of the present invention.

As shown in FIG. 1 a razor handle generally designated by the reference number 10 includes an end portion 12 defining a first bore 14 extending therethrough. In the illustrated embodiment, the handle 10 includes a pair of generally opposed indentations 16 positioned to afford a user a better grip on the handle during a shaving operation. The end portion 12 of the handle 10 defines a second bore 18, the purpose for which will be explained below, substantially perpendicular to, and intersecting the first bore 14.

Figure 2:
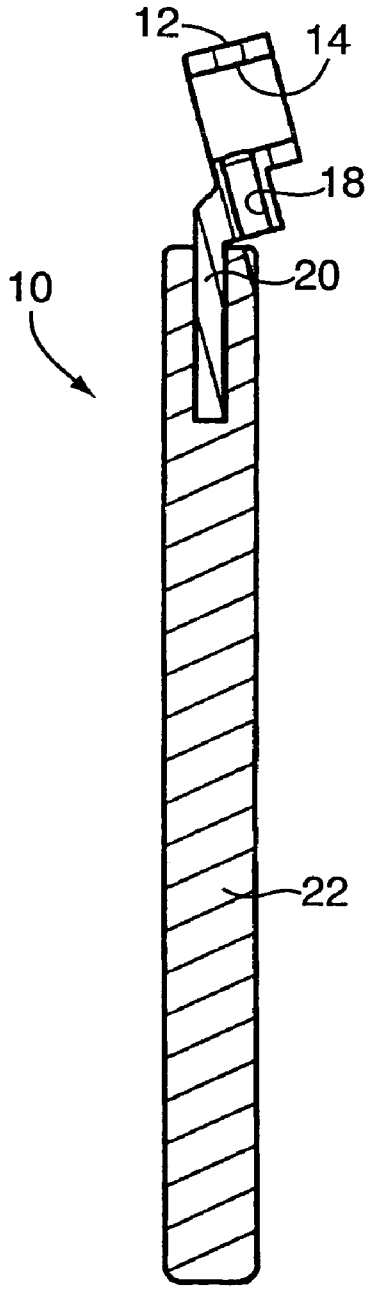
FIG. 2 is a cross sectional view of the handle of FIG. 1 taken along line 2—2.

Referring to FIG. 2, the end portion 12 of the handle 10 is shown as an individual piece that includes an extension 20 projecting into a body section 22 of the handle 10. However, the present invention is not limited in this regard as the handle 10 and the end portion 12 can be formed from a single piece of material.

Figure 3:
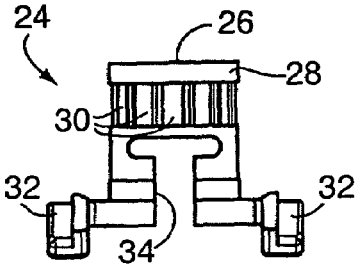
FIG. 3 is a front elevational view of an axle member forming part of an embodiment of the present invention.
Figure 4:
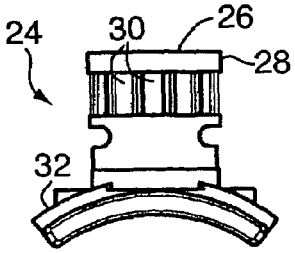
FIG. 4 is a side elevational view of the axle member of FIG. 3.
Figure 5:
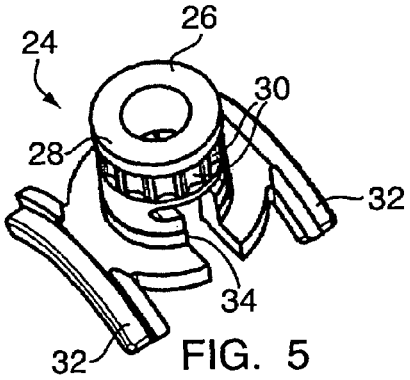
FIG. 5 is a perspective view of the axle member of FIG. 3.

As shown in FIGS. 3–5, an axle member generally designated by the reference number 24 includes a mounted portion 26, which as will be explained below, is rotatably positionable within the first bore 14, FIGS. 1 and 2. A lip 28 forms part of the mounting portion 26 which also includes a plurality of V-shaped grooves 30 equally spaced around a periphery of the mounting portion. While the grooves 30 have been shown and described as being equally spaced, the present invention is not limited in this regard as the grooves can also be unequally spaced without departing from the broader aspects of the present invention. In addition, while V-shaped grooves have been shown and described, the present invention is not limited in this regard either as other groove shapes, or spherical depressions can also be employed.

The axle member 24 includes a pair of arcuate rails 32 spaced apart from, and substantially parallel to one another. As will be explained below, the rails are adapted to releasably retain a razor cartridge on the handle. The axle member 24 defines a slot 34, shown in the illustrated embodiment as being t-shaped, to allow the rails 32 to resiliently flex toward one another. The flexing motion of the rails allows a razor cartridge to be releasably mounted to the cartridge retainer. While a pair of arcuate rails 32 have been shown and described, the present invention is not limited in this regard as other cartridge mounting configurations, such as a posts or retractable pins can be incorporated into the axle member without departing from the broader aspects of the present invention. In addition, while a t-shaped slot 34 has been shown and described the present invention is not limited in this regard either as any shaped slot that would allow the rails 32 to flex toward one another can also be substituted.

Figure 7:
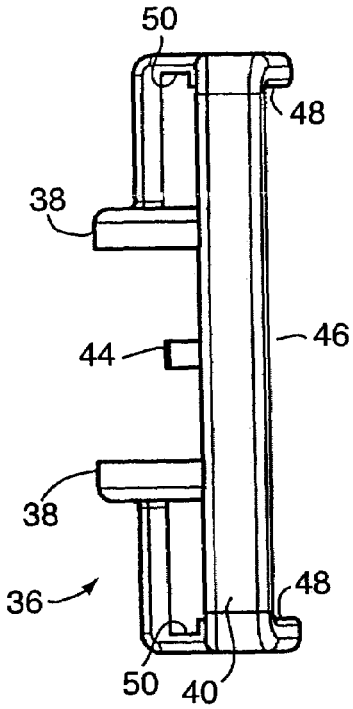
FIG. 7 is a side elevational view of the razor cartridge of FIG. 6.
Figure 6:
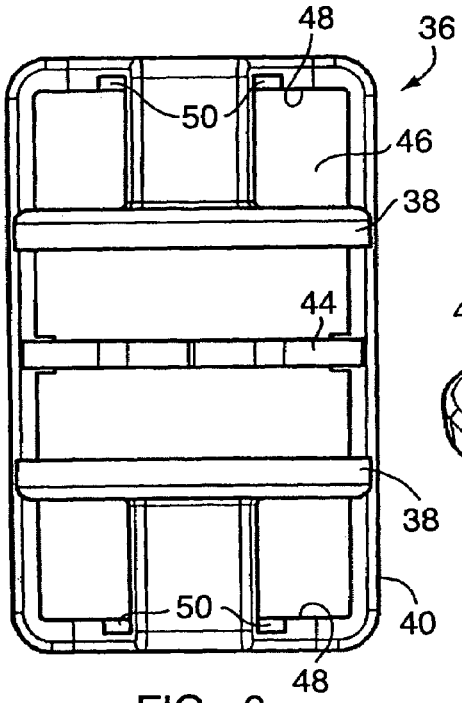
FIG. 6 is a rear elevational view of a razor cartridge forming part of an embodiment of the present invention.
Figure 8:
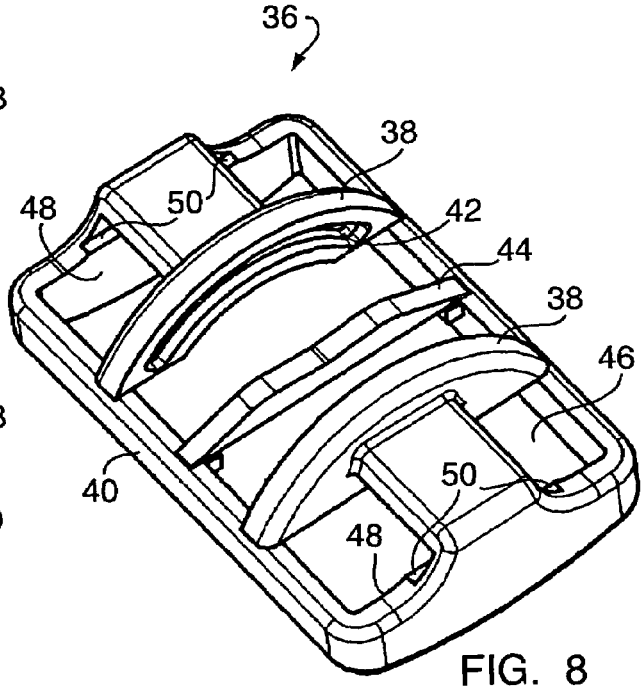
FIG. 8 is a perspective view of the razor cartridge of FIG. 6.

As shown in FIGS. 6–8, a razor cartridge body generally designated by the reference number 36 includes a pair of substantially parallel, spaced apart mounting extensions 38 projecting outwardly from a cartridge body 40. As best seen in FIG. 8, the mounting extensions each define a slot 42 (only one shown) defining a shape complementary to and adapted to slidingly receive at least a portion of the arcuate rails 32 thereby releasably retaining the razor cartridge 36 on the handle 10. A central rib 44, the purpose for which will be explained below, also projects outwardly from the cartridge body 40 and is located between, and substantially parallel to the mounting extensions 38. In addition, the razor cartridge body 36 includes a recessed area 46 defined by a peripheral edge 48 and a pair of generally opposed, spaced apart, stepped portions 50, the purpose of which will be explained in detail below.

Figure 9:
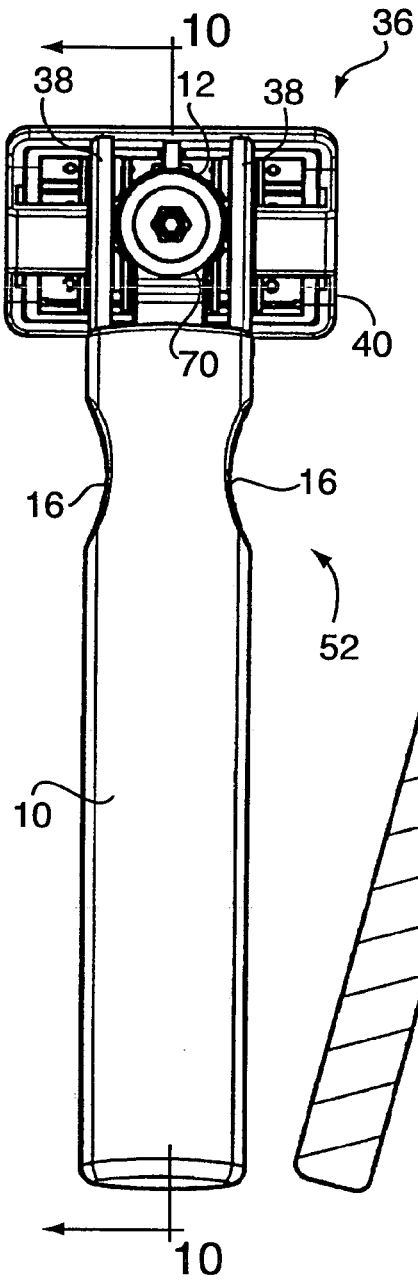
FIG. 9 is a rear elevational view of a razor embodying the present invention with the cartridge shown substantially perpendicular to the razor handle.
Figure 10:
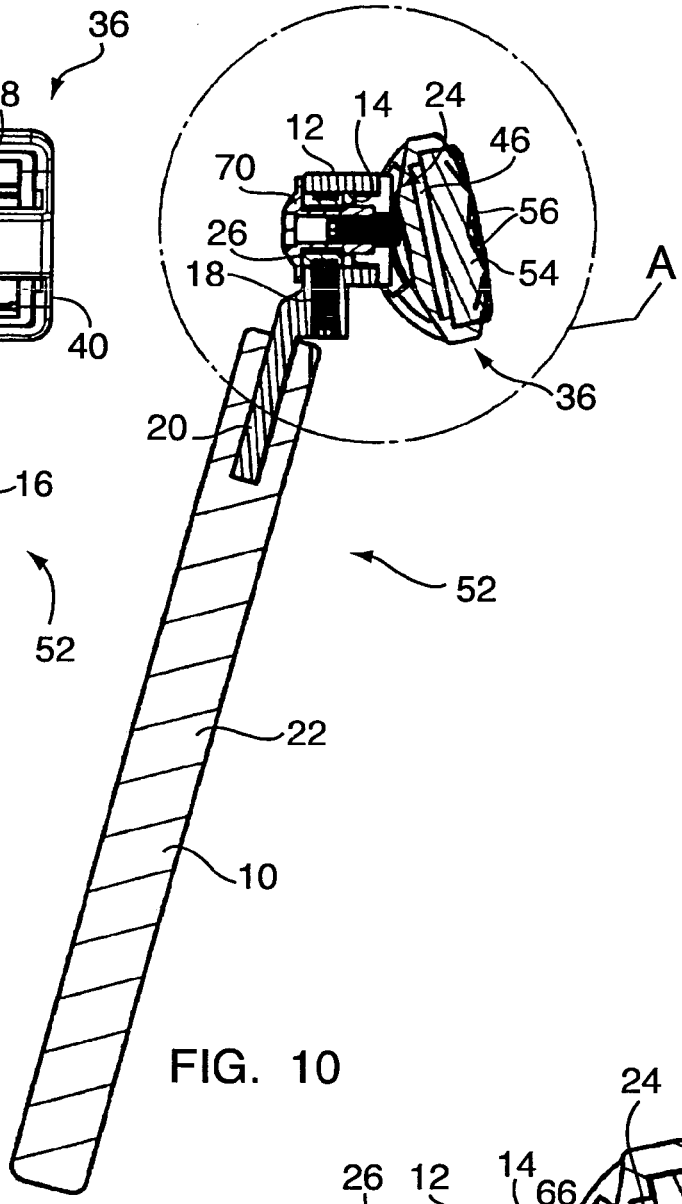
FIG. 10 is cross-sectional view of the razor of FIG. 9 taken along lines 10—10.
Figure 11:
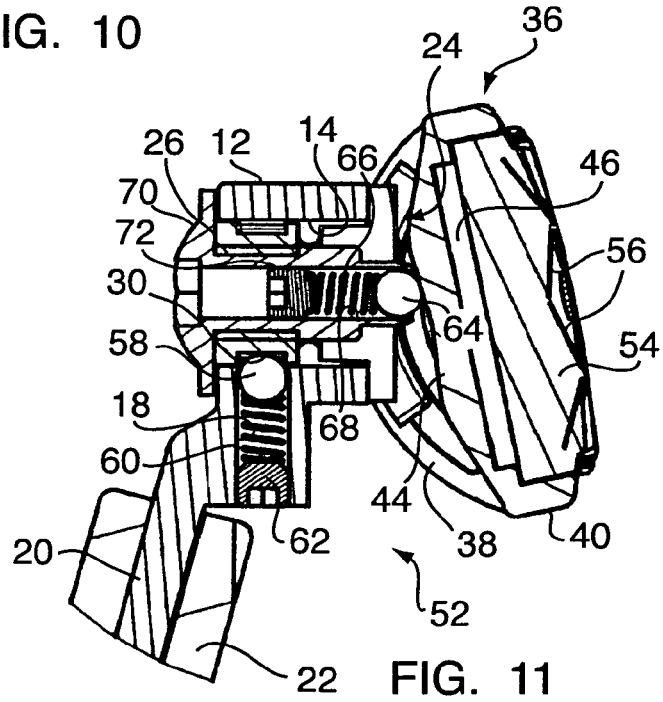
FIG. 11 is an enlarged, partial cross-sectional view of the razor of FIG. 10 as bounded by the line labeled "A".

As shown in FIGS. 9–11, an assembled razor generally designated by the reference number 52 has the mounting portion 26 of the axle member 24 rotatably positioned in the bore 14 of the upper portion 12 of the handle 10. As best seen in FIGS. 10 and 11, a razor cartridge insert 54 is positioned in the recess 46, FIG 7, and includes pairs of generally opposed blades 56 that allow the razor 52 to shave hirsute surfaces by being drawn in either of two generally opposite directions. However, the present invention is not limited in this regard as the razor cartridge insert 54 can also contain a single or multiple blades that provide for unidirectional or bi-directional shaving.

Referring to FIG. 11, a ball 58 and a spring 60 are positioned in the bore 18 defined by the upper portion 12 of the handle 10. The ball and spring, 58 and 60 respectively, are retained in the bore 18 via a plug 62 inserted therein. During operation, the ball 58 is urged against the mounting portion 26 of the axle member 24 and engages one of the grooves 30, thereby releasably retaining the razor cartridge body 36 in place. To rotate the razor cartridge body 36 to a different position, the biasing force of the spring 60 must be overcome forcing the ball 58 to slide into the bore 18 until the next successive groove 30 is encountered. In this manner a ratchet-like movement between the axle member 24 and the handle 10 is achieved.

A second ball 64 and a second spring 66 are inserted into a bore 68 defined by a retainer 70. The retainer 70 extends into the mounting member 26, a second plug 72 retains the second ball and spring, 64 and 66 respectively, in the bore 68. The second spring 66 urges the second ball 64 against the above-described central rib 44, thereby urging the razor cartridge body 36 which is rotatably attached to the axle member 24, toward a neutral position.

Figure 12:
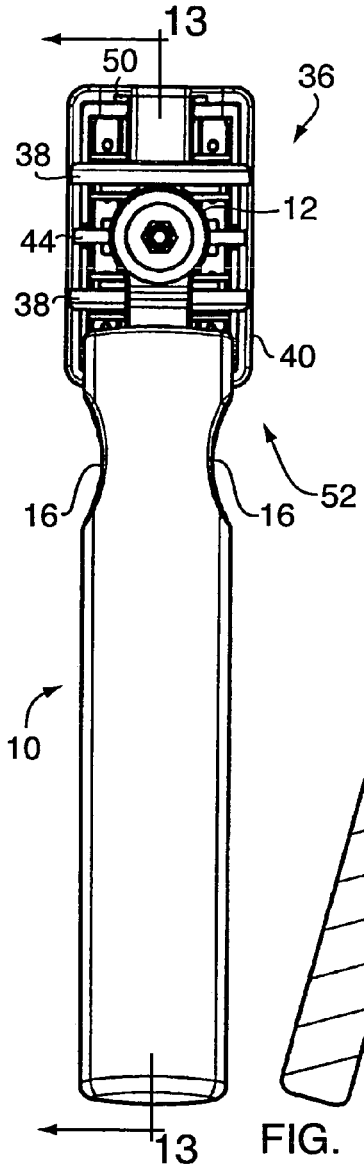
FIG. 12 is a rear elevational view of a razor embodying the present invention with the cartridge shown rotated 90 degrees.
Figure 13:
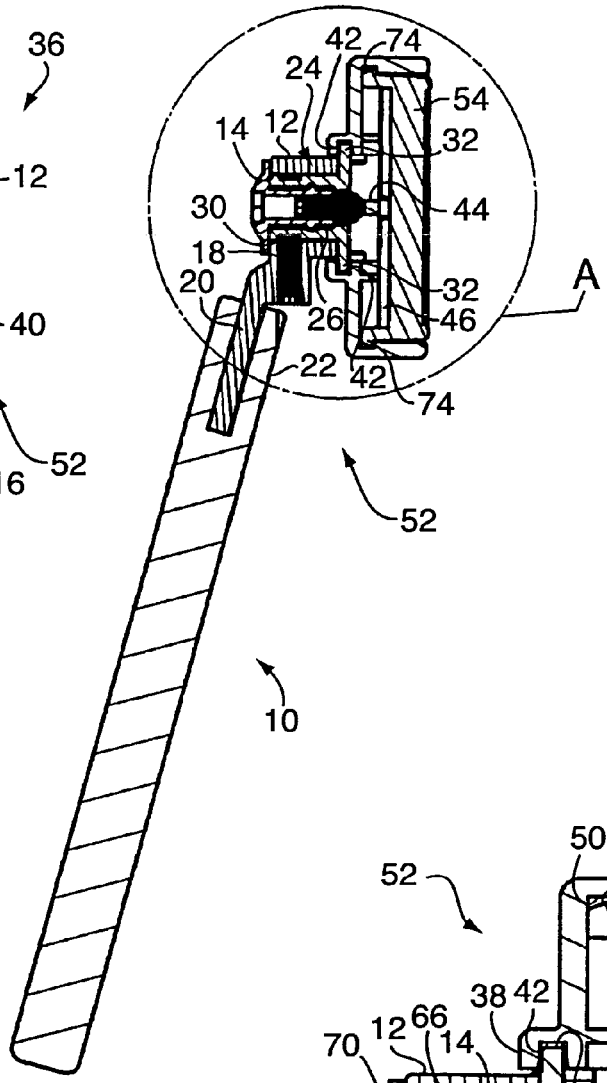
FIG. 13 is a cross-sectional view of the razor of FIG. 13 taken along line 13—13.
Figure 14:
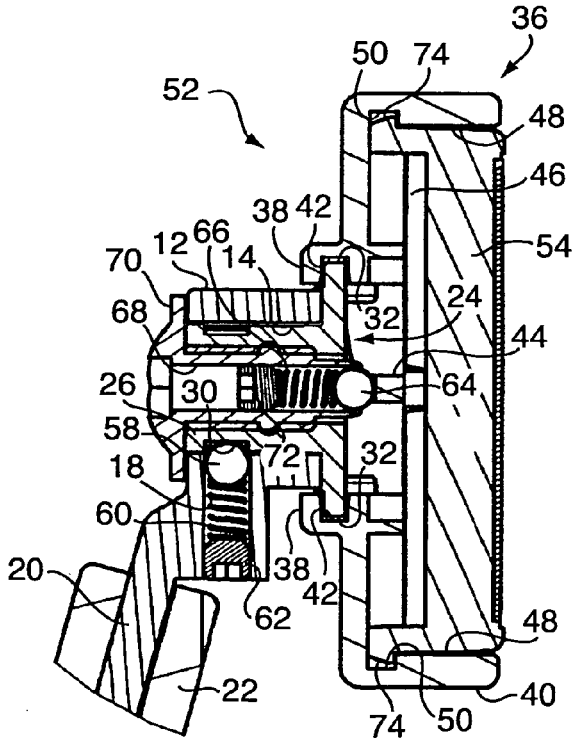
FIG. 14 is an enlarged, partial cross-sectional view of the razor of FIG. 13 as bounded by the line labeled "B".
Figure 15:
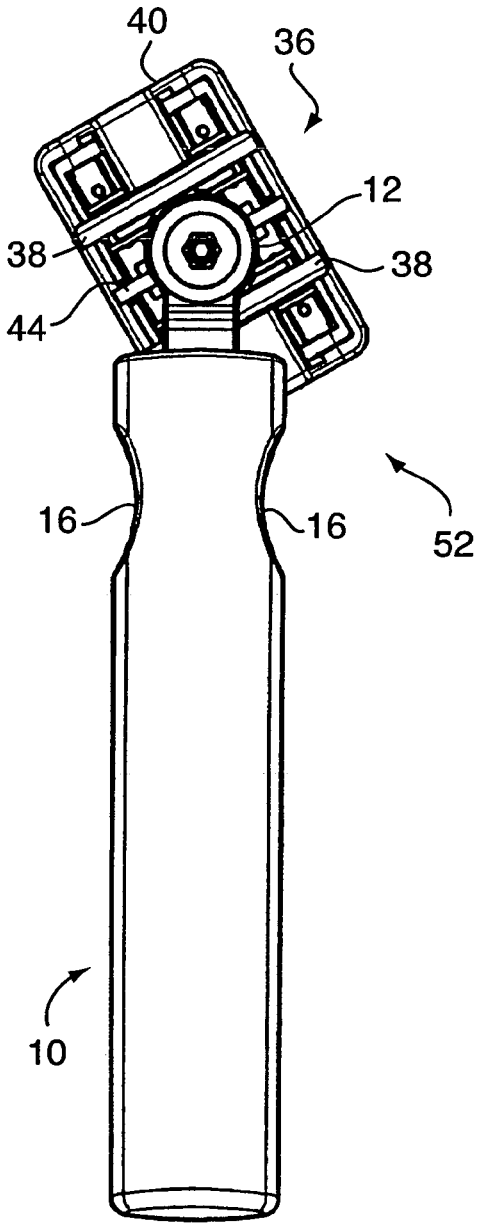
FIG. 15 is a rear elevational view of a razor embodying the present invention with the cartridge shown rotated an amount equal to an angle $\alpha$.
Figure 16:
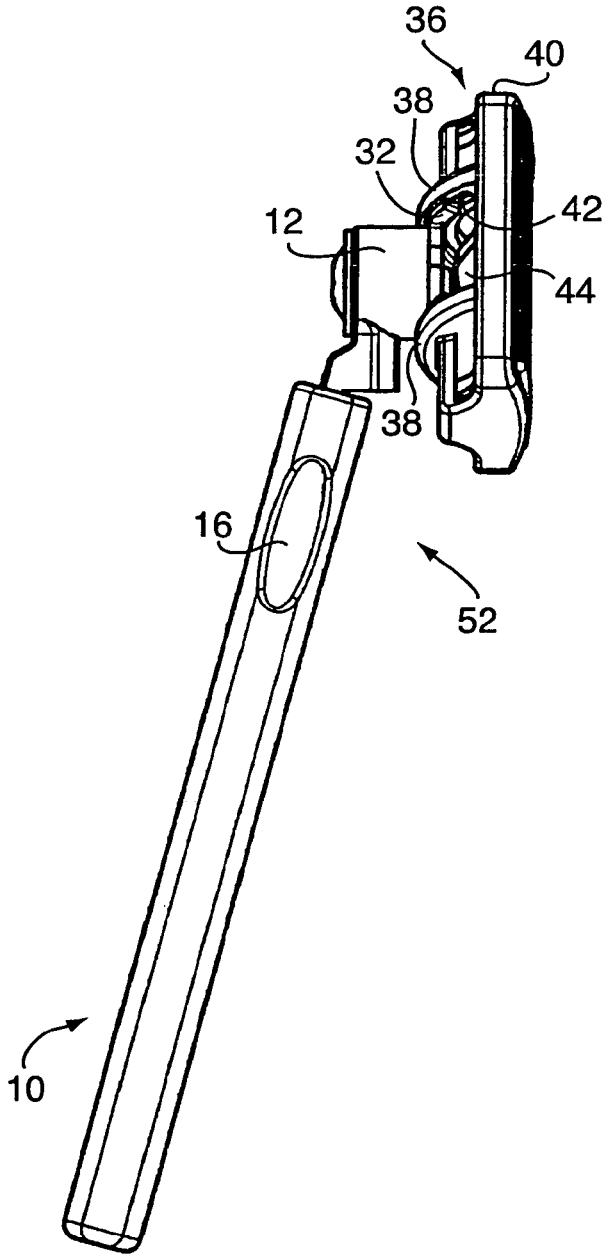
FIG. 16 is a perspective view of the razor of FIG. 15.

As shown in FIGS. 12–14, the razor cartridge body is rotated 90 degrees from the position illustrated in FIGS. 10–12. In addition, the razor cartridge insert 54 includes a pair of generally opposed tabs 74 that engage the stepped portions 50 thereby causing the razor cartridge insert to be retained by the razor cartridge body 36. Turning to FIGS. 15 and 16, the razor cartridge is shown positioned at a location between those shown in FIGS. 9 and 12.

Although the present invention has been described in considerable detail with reference to certain preferred versions thereof, other versions are possible. Therefore, the spirit and scope of the invention should not be limited to the description of the preferred versions contained herein.

What is claimed is:

1. A shaving implement comprising:

a handle having a body section and an end portion projecting outwardly from said body section;

an axle member that includes a mounting portion rotatably receivable in a bore defined by said end portion is rotatably coupled to said bore of said end portion for selective angular movement relative thereto;

a razor cartridge coupled to said axle member and including at least one razor blade defining an at least partially exposed cutting edge, said razor cartridge being rotatably moveable with said axle member relative to said handle; and detent means for releasably retaining said axle member in a user selected angular position relative to said handle, wherein said detent means includes:

at least two recesses circumferentially spaced around said mounting portion of said axle member;

a detent member positioned in said end portion and movable relative thereto, said detent member being movably engageable with said recesses; and biasing means for normally urging said detent member toward said mounting portion of said axle member.

2. A shaving implement as defined by claim 1 wherein said end portion of said handle is integral with said body section of said handle.

3. A shaving implement as defined by claim 1 wherein said end portion defines an outwardly projecting extension receivable in a bore defined by said body section of said handle.

4. A shaving implement as defined by claim 1 wherein:

said biasing means includes a spring positioned in a second bore defined by said end portion, and wherein said detent member is slidably positioned partially in, and extends partially out of said second bore when said detent member engages one of said recesses.

5. A shaving implement as defined by claim 1 wherein said mounting portion defines a plurality of circumferentially spaced recesses whereby rotation of said cartridge results in ratchet-like movement between said axle member and said handle such that a force exerted by said biasing means on said detent member must be overcome, thereby forcing said detent member away from said recess until the next successive recess is encountered.

6. A shaving implement as defined by claim 1, wherein:

said axle member includes means for releasably coupling said razor cartridge thereto.

7. A shaving implement as defined by claim 6 wherein said means for releasably coupling said razor cartridge to said axle member includes a pair of outwardly projecting mounting arms each defining an end portion adapted to releasably enagage a mating surface defined by said razor cartridge, and wherein said axle member defines a slot located between said mounting arms to allow said mounting arms to be resiliently flexible toward one another.

8. A shaving implement as defined by claim 7 wherein said end portion of said mounting arms are in the form of arcuate rails, each slidably engageable with a mating arcuate slot defined by said razor cartridge, thereby allowing said razor cartridge to be rotatably movable relative to said axle member between a neutral and a fully rotated position.

9. A shaving implement as defined by claim 8 further comprising biasing means for normally urging said razor cartridge toward said neutral position in response to forces exerted against said razor cartridge during a shaving operation.

10. A shaving implement as defined by claim 1 wherein:

said razor cartridge includes at least one first razor blade defining an at least partially exposed first cutting edge, and at least one second razor blade defining an at least partially exposed second cutting edge, said first and second razor blades being positioned relative to one another such that during a shaving operation, said razor cartridge cuts hair when drawn over a user's skin in either of two generally opposite directions.

11. A shaving implement comprising:

a handle having a body section and an end portion;

an axle member having a mounting portion rotatably receivable in a bore defined by said end portion of said handle, said mounting portion defining at least two circumferentially spaced recesses;

a razor cartridge coupled to said axle member and including at least one razor blade defining an at least partially exposed cutting edge, said razor cartridge being rotatably moveable with said axle member; and a detent member positioned in said end portion and movable relative thereto, said detent member being engageable with said recesses; and biasing means for normally urging said detent member toward said mounting portion of said axle member.

* * * * *